US010155647B2

(12) United States Patent
Foster et al.

(10) Patent No.: US 10,155,647 B2
(45) Date of Patent: Dec. 18, 2018

(54) APPARATUS FOR DISPENSING A FLAVOURED BEVERAGE

(71) Applicant: Hodges & Drake Design Limited, Leicester (GB)

(72) Inventors: Jody Foster, Leicester (GB); Bhavesh Ranjit, Leicester (GB); Tim Whateley, Leicester (GB); Kevin Hodges, Leicester (GB)

(73) Assignee: Hodges & Drake Design Limited, Leicester (GB)

( * ) Notice: Subject to any disclaimer, the term of this patent is extended or adjusted under 35 U.S.C. 154(b) by 0 days.

(21) Appl. No.: 15/100,830

(22) PCT Filed: Dec. 3, 2014

(86) PCT No.: PCT/GB2014/053590
§ 371 (c)(1),
(2) Date: Jun. 1, 2016

(87) PCT Pub. No.: WO2015/082917
PCT Pub. Date: Jun. 11, 2015

(65) Prior Publication Data

US 2016/0289058 A1 Oct. 6, 2016

(30) Foreign Application Priority Data

Dec. 3, 2013 (GB) ..... 1321295.6

(51) Int. Cl.
*B67D 1/00* (2006.01)
*B67D 1/08* (2006.01)
(Continued)

(52) U.S. Cl.
CPC ..... *B67D 1/0029* (2013.01); *B67D 1/003* (2013.01); *B67D 1/0078* (2013.01);
(Continued)

(58) Field of Classification Search
CPC .. B67D 1/0029; B67D 1/0801; B67D 1/0078; B67D 1/003; B67D 1/0858;
(Continued)

(56) References Cited

U.S. PATENT DOCUMENTS 3,803,870 A * 4/1974 Conz ..... A23G 9/16 141/104
5,797,519 A * 8/1998 Schroeder ..... B67D 1/0032 222/129.1
(Continued)

FOREIGN PATENT DOCUMENTS

EP 0176318 A2 4/1986
GB 2340415 A 2/2000
(Continued)

OTHER PUBLICATIONS

UKIPO, Search Report for GB Patent Application No. GB1421447.2, Date of Search May 22, 2015.
(Continued)

*Primary Examiner* — Donnell Long
(74) *Attorney, Agent, or Firm* — NK Patent Law

(57) ABSTRACT

Apparatus (10) for dispensing a flavored, optionally alcoholic, beverage, is housed in a cabinet (16) and comprises a dispensing outlet (12) connectable to a beverage supply and a plurality of different liquid beverage flavorings, the dispensing outlet being configured to dispense the beverage and one or more of said flavorings into a drinking container. An actuating member (44) is operable to initiate dispensing of the beverage and one or more of said flavorings from the dispensing outlet. The apparatus includes a selector (42) configured to receive a user input selection of one or more of the beverage flavorings to be dispensed and a control unit (40). Upon user operation of the actuating member (44), the control unit (40) operates a pump (24*a-f*) to supply a selected
(Continued)

one or more of the flavorings to the dispensing outlet based on the user input selection.

18 Claims, 15 Drawing Sheets

(51) Int. Cl.
*B67D 1/10* (2006.01)
*B67D 1/12* (2006.01)

(52) U.S. Cl.
CPC ..... *B67D 1/0079* (2013.01); *B67D 1/0801* (2013.01); *B67D 1/0858* (2013.01); *B67D 1/0884* (2013.01); *B67D 1/108* (2013.01); *B67D 1/0039* (2013.01); *B67D 1/0875* (2013.01); *B67D 2001/082* (2013.01); *B67D 2001/0812* (2013.01); *B67D 2001/1259* (2013.01); *B67D 2210/00031* (2013.01)

(58) Field of Classification Search
CPC .... B67D 1/0884; B67D 1/108; B67D 1/0079; B67D 2001/082; B67D 2210/00031; B67D 1/0039; B67D 1/0875; B67D 2001/1259; B67D 2001/0812
USPC ..... 222/129.3, 129.1, 325, 185.1
See application file for complete search history.

(56) References Cited

U.S. PATENT DOCUMENTS 6,003,733 A * 12/1999 Wheeler ..... B67D 1/0004 222/146.5
7,997,448 B1 * 8/2011 Leyva ..... B67D 1/0044 222/1
2004/0026451 A1 2/2004 Jones
2005/0112249 A1 * 5/2005 Herrick ..... A23C 9/133 426/249
2006/0115570 A1 6/2006 Guerrero et al.
2007/0029005 A1 2/2007 Huang et al.
2007/0068969 A1 * 3/2007 Orzech ..... B67D 1/108 222/214
2007/0114244 A1 5/2007 Gatipon et al.
2007/0205220 A1 * 9/2007 Rudick ..... B67D 1/0025 222/129.4
2008/0023488 A1 1/2008 Guerrero et al.
2009/0008407 A1 1/2009 Sevcik et al.
2009/0285966 A1 11/2009 Tso et al.
2010/0005903 A1 1/2010 Beavis
2010/0116842 A1 5/2010 Hecht et al.
2010/0147414 A1 * 6/2010 Nighy ..... B65B 3/045 141/10
2010/0186851 A1 * 7/2010 Rusch ..... B67D 1/0004 141/383
2014/0209634 A1 7/2014 Metropulos et al.
2015/0375982 A1 * 12/2015 Bencista' Falorni . B67D 1/0406 222/401

FOREIGN PATENT DOCUMENTS

GB 2390080 A 12/2003
GB 2445174 A 7/2008
WO WO 9816459 A1 * 4/1998 ..... B67D 1/0007
WO 2006101394 A2 9/2006
WO 2008084234 A2 7/2008

OTHER PUBLICATIONS

Patent Seekers Ltd., Patentability Search Report for GB Patent Application No. GB1321295.6, Date of Search Jul. 24, 2014.

* cited by examiner

APPARATUS FOR DISPENSING A FLAVOURED BEVERAGE

TECHNICAL FIELD

The present disclosure relates generally to an apparatus for dispensing a flavoured beverage, in particular but not exclusively for dispensing a flavoured alcoholic beverage such as a standard measure of a flavoured alcoholic spirit. The apparatus is housed in a cabinet and thus takes the form of a beverage dispensing machine for dispensing a flavoured beverage.

TECHNICAL BACKGROUND

Simple dispensing devices for dispensing a standard measure of alcoholic spirit are well known and include the thimble measure and the optic (registered trade mark). In recent years, consumers have become increasingly attracted to flavoured alcoholic spirits but these cannot be reliably dispensed using the aforementioned dispensing devices.

As a result, bottles of pre-flavoured alcoholic spirits, such as vodka, which are flavoured during the production process, by the drinks producer, are widely available. There is, however, currently no way of conveniently dispensing an alcoholic spirit which can be flavoured at the point of sale and consumption, for example in a bar or other licensed premises, according to the consumer's preference. This limits consumer choice and potentially limits the revenue available for the drinks producer.

SUMMARY OF THE DISCLOSURE

According to a first aspect of the present disclosure, there is provided an apparatus for dispensing a flavoured beverage, the apparatus being housed in a cabinet and comprising:

- a dispensing outlet connectable to a beverage supply and a plurality of different liquid beverage flavourings, the dispensing outlet being configured to dispense the beverage and a selected one or more of the liquid beverage flavourings into a drinking container;
- an actuating member operable by a user to initiate dispensing of the beverage and a selected one or more of the liquid beverage flavourings from the dispensing outlet;
- a selector configured to receive a user input selection of one or more of the plurality of liquid beverage flavourings to be dispensed; and
- a control unit;
- wherein, upon user operation of the actuating member, the control unit is arranged to operate a pump to supply a selected one or more of the liquid beverage flavourings to the dispensing outlet based on the user input selection received by the selector.

The apparatus may be arranged to dispense a flavoured alcoholic beverage, in particular a flavoured alcoholic spirit such as vodka, gin, whiskey, etc. In this case, it will be understood that the beverage supply is an alcoholic beverage supply. The apparatus is, however, suitable for dispensing alcoholic beverages and non-alcoholic beverages.

The apparatus allows a beverage, in particular an alcoholic beverage such as a standard measure of alcoholic spirit, to be dispensed and flavoured with any one or more of a variety of flavourings chosen by the consumer at the point of sale and consumption in a simple and effective manner. The consumer is, thus, able to choose from a wider variety of flavourings than might previously have been available (for example in the form of pre-flavoured bottled alcoholic beverages), thereby potentially making the alcoholic beverage more appealing.

From the view point of the drinks producer, the production process is simplified because, in the case of an alcoholic beverage, the alcoholic beverage no longer has to be flavoured during production and stored in a container or bottle that requires specific labelling, etc. This means that a wider variety of flavourings can be offered to the consumer. Furthermore, if a certain flavouring proves to be unpopular, it is likely that only the unpopular flavouring (an inexpensive component compared to the alcoholic beverage) will not be consumed whilst the remainder of the alcoholic beverage will be consumed in conjunction with more popular flavourings that are available for dispensing by the apparatus. The level of consumption, and hence popularity, of different flavourings would also provide extremely useful feedback to the drinks producer, for example enabling them to develop new flavourings and to discontinue unpopular flavourings.

According to one embodiment, there is provided an apparatus for dispensing a flavoured alcoholic beverage comprising:

- a dispensing outlet connectable to an alcoholic beverage supply and a plurality of different liquid beverage flavourings, the dispensing outlet being configured to dispense the alcoholic beverage and a selected one of the liquid beverage flavourings into a drinking container;
- an actuating member operable by a user to initiate dispensing of the alcoholic beverage and a selected one of the liquid beverage flavourings through the dispensing outlet;
- a selector configured to receive a user input selection of one of the plurality of liquid beverage flavourings to be dispensed; and
- a control unit;
- wherein, upon user operation of the actuating member, the control unit is arranged to operate a pump to supply a selected one of the liquid beverage flavourings to the dispensing outlet based on the user input selection received by the selector.

The apparatus may be housed in a cabinet which is dimensioned for location on a counter top. The apparatus may, thus, take the form of a beverage dispensing machine which is readily portable.

The apparatus may include a plurality of pumps and each pump may be arranged to supply one of the liquid beverage flavourings to the dispensing outlet. Because each liquid beverage flavouring is supplied by a dedicated pump, cross-contamination between flavourings is avoided. Each of the pumps may be a peristaltic pump.

The apparatus may be configured to simultaneously dispense the beverage and the selected one or more of the liquid beverage flavourings into a drinking container for consumption, upon user operation of the actuating member. Dispensing of the beverage and the selected liquid beverage flavouring(s) is thus achieved in a rapid and simple manner when a user operates the actuating member.

The dispensing outlet may include an aperture for dispensing the beverage and at least one further aperture for dispensing the selected one or more of the liquid beverage flavourings. The dispensing outlet may include a plurality of said further apertures each of which is arranged to dispense only one of the liquid beverage flavourings. The beverage and liquid beverage flavouring(s) are thus mixed as they flow into the drinking container and in the drinking container itself, but not inside the dispensing apparatus. The use of dedicated apertures for the beverage and each of the liquid beverage flavourings again ensures that there is no cross-contamination.

Each of the liquid beverage flavourings may be stored in a separate, individually removable and replaceable, liquid flavouring container. The liquid beverage flavourings can, therefore, be easily replenished by replacing one or more empty containers.

Each liquid flavouring container may be connected by a hose to a flavour dispensing nozzle at the dispensing outlet. With this arrangement, each liquid beverage flavouring is delivered from its liquid flavouring container via a dedicated hose to a dedicated nozzle provided at the dispensing outlet. Cross-contamination between different liquid beverage flavourings is thus avoided.

Each liquid flavouring container may be mounted, e.g. removably mounted, on a respective container support. Each container support may have an integrated pump, e.g. a peristaltic pump, for delivering the liquid beverage flavouring from the liquid flavouring container along the hose to the flavour dispensing nozzle. The apparatus may include a plurality of rotary drives, each rotary drive being arranged to engage a rotor of one of the peristaltic pumps to operate the peristaltic pump. The control unit may be arranged to operate one or more selected rotary drives to dispense the selected one or more of the liquid beverage flavourings in accordance with the user input selection received by the selector. Each rotary drive may comprise an electric motor which may have a drive part engageable with the rotor of the peristaltic pump.

Each liquid flavouring container and associated container support may be mounted, e.g. removably mounted, in a cartridge and the cartridge may be removably located in the cabinet, for example in a predetermined cartridge bay in the cabinet. When a liquid flavouring needs to be replaced, a user simply has to remove the appropriate cartridge from the cartridge bay in the cabinet along with the associated hose and dispensing nozzle provided at the dispensing outlet. A replacement cartridge, with a pre-connected hose and dispensing nozzle, can then be located in the appropriate cartridge bay in the cabinet, the dispensing nozzle can be located at the dispensing outlet and the hose can be suitably routed between the cartridge and the dispensing outlet, for example by mounting it in suitable guides or clips. With this arrangement, it will be understood that the removal of the cartridge from the cartridge bay in the cabinet disengages the rotary drive from the pump rotor because the container support (having the integrated pump with pump rotor) is itself mounted in the cartridge.

The control unit may be configured to operate the or each pump to supply a predetermined volume of the selected one or more of the liquid beverage flavourings to the dispensing outlet. As indicated above, each pump may be a peristaltic pump. The peristaltic pumps could be operated for a predetermined period of time to dispense the predetermined volume of the selected one or more liquid beverage flavourings, for example based on a calibrated dispensing rate.

The apparatus may be configured to dispense a predetermined volume of beverage through the dispensing outlet upon user operation of the actuating member.

The apparatus may include a dispensing chamber configured to store the predetermined volume of beverage to be dispensed from the dispensing outlet. The dispensing chamber may form part of an optic device. The use of an optic device is particularly advantageous when the beverage is an alcoholic beverage such as an alcoholic spirit.

The apparatus may include a storage tank for the beverage. The storage tank may include a first storage compartment, e.g. for storing the beverage at a first temperature, and may include a second storage compartment, e.g. for storing the beverage at a second temperature. The second temperature may be lower than the first temperature and is typically the desired dispensing temperature for the beverage. The second storage compartment may be in fluid communication with the dispensing chamber, and thus the temperature of the beverage in the dispensing chamber is the second temperature, i.e. the same temperature as the beverage in the second storage compartment.

The apparatus may include a refrigeration unit for cooling the beverage to the second temperature. The refrigeration unit may include a chiller tank which may be in fluid communication with the first and second storage compartments. The apparatus may be arranged to supply beverage, e.g. at the first temperature, from the first storage compartment to the chiller tank and may be arranged to deliver chilled beverage at the second temperature to the dispensing chamber. Thus, it will be understood that the first storage compartment acts as a supply for the chiller tank and that the second storage compartment stores chilled beverage which can be supplied to the dispensing chamber, and hence to the second storage compartment by virtue of the fact that it is in fluid communication with the dispensing chamber.

The chiller tank may be positioned below the storage tank so that the beverage may be supplied from the first storage compartment to the chiller tank by gravity feed. The first storage compartment thus acts as a header tank for the chiller tank. The apparatus may include a pump, e.g. a diaphragm pump, for delivering the chilled beverage at the second temperature from the chiller tank to the dispensing chamber. When chilled beverage is delivered from the chiller tank to the dispensing chamber by the pump, beverage, e.g. at the first temperature, is immediately delivered from the first storage compartment to the chiller tank by gravity feed where it is cooled to the second temperature by the refrigeration unit.

The pump may be selectively operable to circulate the beverage around a cooling loop from the second storage compartment to the first storage compartment, from the first storage compartment to the chiller tank and from the chiller tank to the dispensing chamber. The pump may be selectively operable at predetermined intervals and for a predetermined period of time to circulate the beverage and may thus provide for intermittent circulation of the beverage around the cooling loop. This ensures that the beverage in the dispensing chamber and second storage compartment is maintained substantially at the second temperature ready for dispensing.

The refrigeration unit may include an evaporator coil which may be positioned around the chiller tank to cool the beverage inside the chiller tank to the second temperature. The refrigeration unit may include a temperature selector to allow a user to select the second temperature. This allows the second temperature, at which the beverage is dispensed, to be easily controlled.

In another embodiment, the apparatus may include a main container for the beverage supply, a secondary container for intermediate storage of the beverage, and a pump to supply the beverage from the main container to the secondary container. The secondary container may be positioned above the dispensing chamber to supply the beverage to the dispensing chamber under gravity to fill the dispensing chamber. The secondary container thus provides a continuous supply of the beverage to the dispensing chamber.

In another embodiment, the apparatus may include a main container for the beverage supply, and a pump to supply the beverage from the main container to the dispensing chamber to fill the dispensing chamber.

In another embodiment, the dispensing chamber may be configured to communicate directly with an inverted container locatable above the chamber and containing the beverage so that the beverage is supplied directly from the container to the dispensing chamber under gravity to fill the dispensing chamber. This arrangement is similar to that used with a standard optic device, in which a bottle containing alcoholic spirit is inverted to provide a constant supply to the optic device.

In another embodiment, the apparatus may include a main container for the beverage and a pump, e.g. a peristaltic pump, to supply the beverage from the main container directly to the dispensing outlet.

The secondary container may be refrigerated or cooled. This ensures that the beverage is stored at the required temperature. Alternatively or in addition, the main container may be refrigerated or cooled.

The apparatus may include a bottle mounting assembly for removably mounting an inverted bottle containing a supply of the beverage, and may include a delivery pump, e.g. a diaphragm pump, for delivering the beverage from the inverted bottle to the first storage compartment via a delivery tube. The control unit may be adapted to operate the delivery pump when the volume of beverage in the first storage compartment is less than a predetermined amount. This arrangement provides added user convenience, because it is not necessary for a user to directly refill the first storage compartment in the storage tank.

The bottle mounting assembly may comprise: a collar for receiving a stopper valve, having a spring-biased plunger closing a discharge orifice, fitted to the bottle; an actuating spigot arranged to depress the spring-biased plunger to allow the beverage to flow from the inverted bottle through the discharge orifice; and a sealing member arranged to contact a neck of the stopper valve. The sealing member may comprise a circumferentially extending seal which may have a downwardly depending lip on its inner circumference. The stopper valve prevents the discharge of liquid beverage from the bottle when the bottle is inverted. The stopper valve allows the discharge of liquid beverage from the inverted bottle only when the stopper valve is correctly seated in the collar causing the actuating spigot to depress the spring-biased plunger and thereby open the discharge orifice.

The collar may include a vent hole and associated one-way air inlet valve, e.g. an umbrella valve, which may be arranged to allow air to flow into the inverted bottle as beverage is delivered from the inverted bottle to the first storage compartment by the delivery pump. The vent hole may be provided in the collar at a vertical position below the sealing member and above a lower periphery of the neck of the stopper valve when the stopper valve is located in the collar.

The bottle mounting assembly may include a liquid sensor for detecting the presence of liquid beverage in the inverted bottle.

The cabinet may include a compartment for the liquid flavouring containers and may include one or more access panels.

DETAILED DESCRIPTION OF EMBODIMENTS

Figure 1:
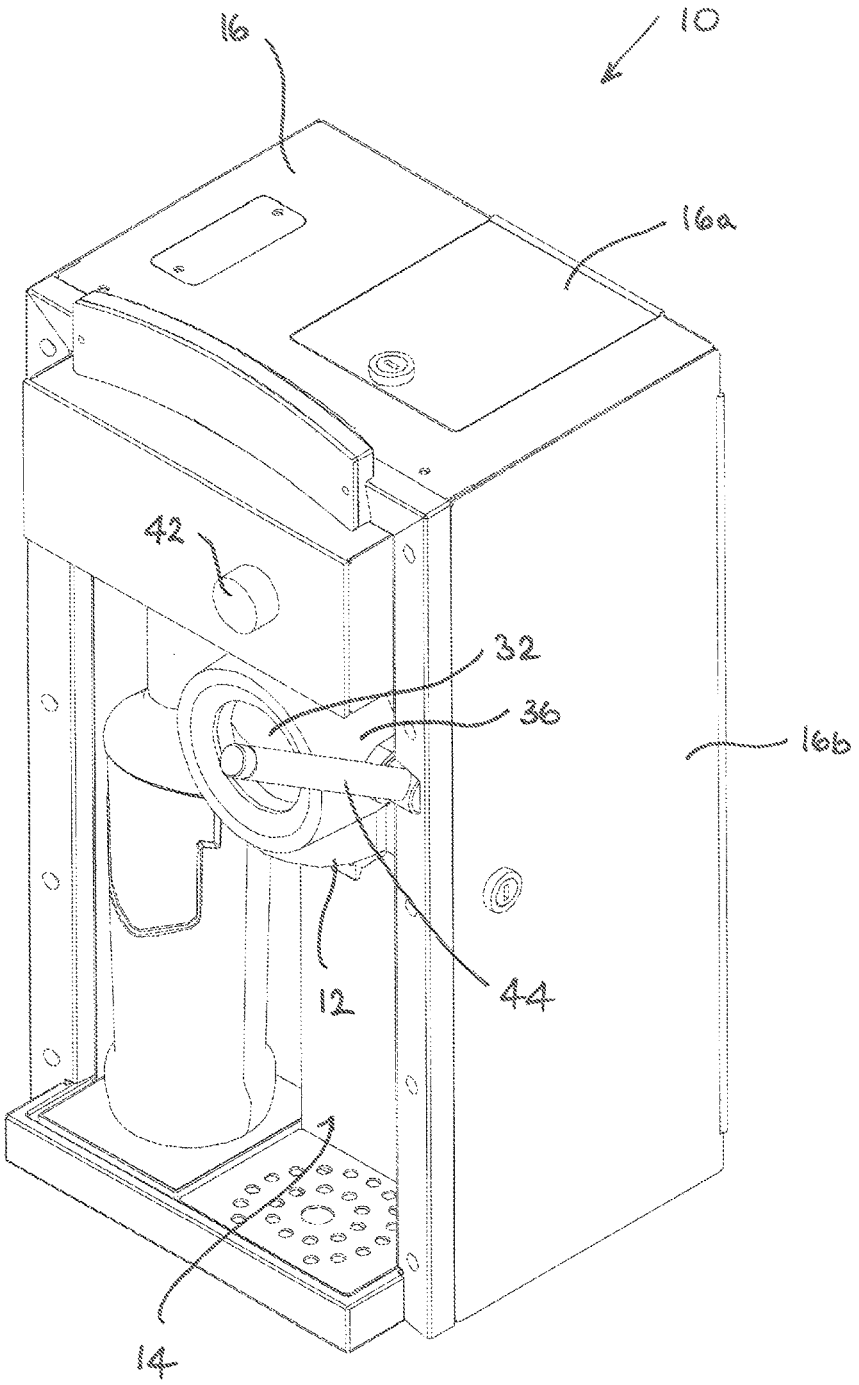
FIG. 1 is a diagrammatic perspective view of an apparatus for dispensing a flavoured alcoholic beverage according to a first embodiment of the present disclosure.

Embodiments of the present disclosure will now be described by way of example only and with reference to the accompanying drawings.

Referring initially to FIGS. 1 to 5, a first embodiment of an apparatus 10 for dispensing a flavoured alcoholic beverage, in particular a flavoured alcoholic spirit such as vodka, gin, whiskey, etc., comprises a dispensing outlet 12 from which both the alcoholic spirit and a liquid beverage flavouring are dispensed into a drinking container (not shown), locatable beneath the dispensing outlet 12 at a dispensing location 14. The dispensed alcoholic spirit and liquid beverage flavouring become mixed together as they flow into the drinking container and in the drinking container itself to form the flavoured alcoholic beverage. The apparatus 10 is housed in a cabinet 16 having top and side access panels 16*a*, 16*b*.

The apparatus 10 is loaded with a plurality of different liquid flavourings, each of which is stored in a separate liquid flavouring container 18*a-f*. Any suitable liquid flavouring can be used to impart a desired flavour to the alcoholic spirit. As best seen in FIG. 3, the illustrated embodiment of the apparatus 10 is configured to be loaded with six different liquid flavouring containers 18*a-f*, but it will be appreciated that the apparatus 10 can be configured for use with any desired number of liquid flavouring containers 18. The apparatus 10 includes a compartment 20 for the liquid flavouring containers 18 which are removably located in a tray 22 which is slidable into and out of the compartment 20 as is evident from a comparison of FIGS. 2 and 3.

Each of the liquid flavouring containers 18*a-f* is connected to a pump 24*a-f* (best seen in FIG. 5), for example a peristaltic pump, which is operable to deliver a predetermined volume of the liquid beverage flavouring to the dispensing outlet 12 for dispensing into the drinking container. Connecting hoses (omitted for clarity purposes) connect each pump 24*a-f* to a respective liquid flavouring container 18*a-f* and to a respective dispensing aperture 26*a-f* provided at the dispensing outlet 12 through which the liquid beverage flavourings are dispensed into the drinking container.

The apparatus 10 comprises a main container 28 for storing the alcoholic spirit. The top access panel 16*a* provides access to the main container 28 so that it can be filled and refilled as necessary simply by pouring the alcoholic spirit from a bottle or similar receptacle. The apparatus 10 also comprises a secondary container 30 for intermediate storage of the alcoholic spirit and a dispensing chamber 32 from which the alcoholic spirit is dispensed, through an aperture 33 in the dispensing outlet 12, into the drinking container. A pump 34, for example a peristaltic pump, is provided to supply the alcoholic spirit from the main container 28 to the secondary container 30 and the pump 34 can operate to refill the secondary container 30 for example when the level of alcoholic spirit within the secondary container 30 falls below a predetermined level. If desired, either one or both of the main container 28 and the secondary container 30 can be cooled or refrigerated to maintain the alcoholic spirit at a desired temperature.

In the illustrated embodiment, the dispensing chamber 32 forms part of an optic device 36 and the chamber volume thus corresponds to a standard measure of the alcoholic spirit to be dispensed (e.g. 25 ml or 35 ml) for consumption. The secondary container 30 is located above the dispensing chamber 32 and is in communication with the dispensing chamber 32 so that the alcoholic spirit flows from the secondary container 30 into the dispensing chamber 32 under gravity to fill the dispensing chamber 32. When the dispensing chamber 32 is opened to dispense the measured volume of alcoholic spirit under gravity from the dispensing chamber 32 into the drinking container below, communication between the secondary container 30 and the dispensing chamber 32 is temporarily interrupted so that only the measured volume is dispensed. After dispensing, the communication between the secondary container 30 and the dispensing chamber 32 is re-established so that the dispensing chamber 32 is refilled with alcoholic spirit from the secondary container 30 ready for the next dispensing operation.

The apparatus 10 includes a rotatable selector 42 which is associated with a control unit 40 (see FIG. 4) which controls the dispensing operation, in particular the operation of the pumps 24*a-f*, 34, as well as the general operation of the apparatus 10. The rotatable selector 42 can be rotated by a user to a number of positions, each position corresponding to one of the available liquid beverage flavourings in the liquid flavouring containers 18*a-f*. The rotatable selector 42 thus allows a user to easily select which liquid beverage flavouring they wish to be dispensed through the dispensing outlet 12 to flavour the alcoholic spirit dispensed from the dispensing chamber 32.

In order to prepare the apparatus 10 so that it is ready for use, a plurality of liquid flavouring containers 18*a-f* containing a desired selection of liquid beverage flavourings are loaded into the tray 22 and each liquid flavouring container 18*a-f* is connected to a respective one of the pumps 24*a-f* by a connecting hose. Each liquid flavouring container 18*a-f* is connected to the appropriate pump 24*a-f* to ensure that the correct liquid beverage flavouring is dispensed from the dispensing outlet 12 based on the user selection made via the rotatable selector 42. Typically, the pumps 24*a-f* are primed to remove air from the system, for example from the connecting hoses. The main container 28 is also filled with a suitable alcoholic spirit (e.g. vodka, gin, whiskey) and the pump 34 is operated to fill the secondary container 30. As explained above, alcoholic spirit flows from the secondary container 30 into the dispensing chamber 32 of the optic device 36 under gravity. The tray 22 is slid into the compartment 20 and the access covers 16*a*, 16*b* are closed to ready the apparatus 10 for use. For the avoidance of doubt, the aforementioned steps do not have to be carried out in this exact sequence and any suitable sequence can be adopted.

The apparatus 10 is typically located on a counter top, such as a bar counter, along with other alcoholic beverages at a location where the flavoured alcoholic beverage will be consumed. Depending on the particular flavour of alcoholic spirit required by the consumer, the user (typically a bar tender) will rotate the selector 42 to select the desired flavouring and that selection will be communicated to the control unit 40. The apparatus 10 may include lighting whose colour may change based on the position of the selector 42 to distinguish between different liquid beverage flavouring selections. Alternatively or in addition, the apparatus 10 may include a display screen (not shown) which may be used to display advertising media, for example relating to the alcoholic spirit in the main container 28.

In order to initiate the dispensing operation, the user operates an actuating member which in the illustrated embodiment is in the form of a rotatable handle member 44. The actuating member could, of course, take any suitable form, such as a push button. When the handle member 44 is rotated by a user (in the downward direction), it acts mechanically on the optic device 36 so that the measured volume of alcoholic spirit is dispensed in the manner explained above from the dispensing chamber 32 via the aperture 33 into the drinking container positioned beneath the dispensing outlet 12. The handle member 44 is typically held in the rotated position until the measured volume of alcoholic spirit has been dispensed from the dispensing chamber 32 and is then released so that it can return under the action of a biasing member (e.g. a spring) back to its starting position.

The rotation of the handle member 44 by the user also operates a switch which causes the control unit 40 to operate the appropriate pump 24*a-f* to supply the liquid beverage flavouring selected by the user via the selector 42 from the liquid flavouring container 18*a-f* to the corresponding dispensing aperture 26*a-f*. The selected liquid beverage flavouring is thus dispensed through the appropriate dispensing aperture 26*a-f* into the drinking container. The control unit 40 is calibrated to operate each pump 24*a-f* so that a predetermined volume of the liquid beverage flavouring is dispensed from the dispensing outlet 12. The predetermined volume will, of course, depend on the particular composition of the liquid beverage flavouring and re-calibration is possible to vary the predetermined dispensing volume.

Typically, both the alcoholic spirit and the selected liquid beverage flavouring are dispensed simultaneously from the dispensing outlet 12 into the drinking container. This is, however, not strictly necessary and the alcoholic spirit and the selected liquid beverage flavouring could instead be dispensed sequentially, in any order. When the alcoholic spirit and the selected liquid beverage flavouring are dispensed simultaneously, the dispensing operation might take approximately 3 seconds (for a 25 ml measured volume of alcoholic spirit), so it will be readily appreciated that the dispensing operation is completed in a very short period of time.

Once the dispensing operation has been completed, alcoholic spirit flows under gravity, in the manner described above, from the secondary container 30 into the dispensing chamber 32 to refill it and the apparatus can be operated again in the manner described above to dispense further flavoured alcoholic spirits.

Figure 2:
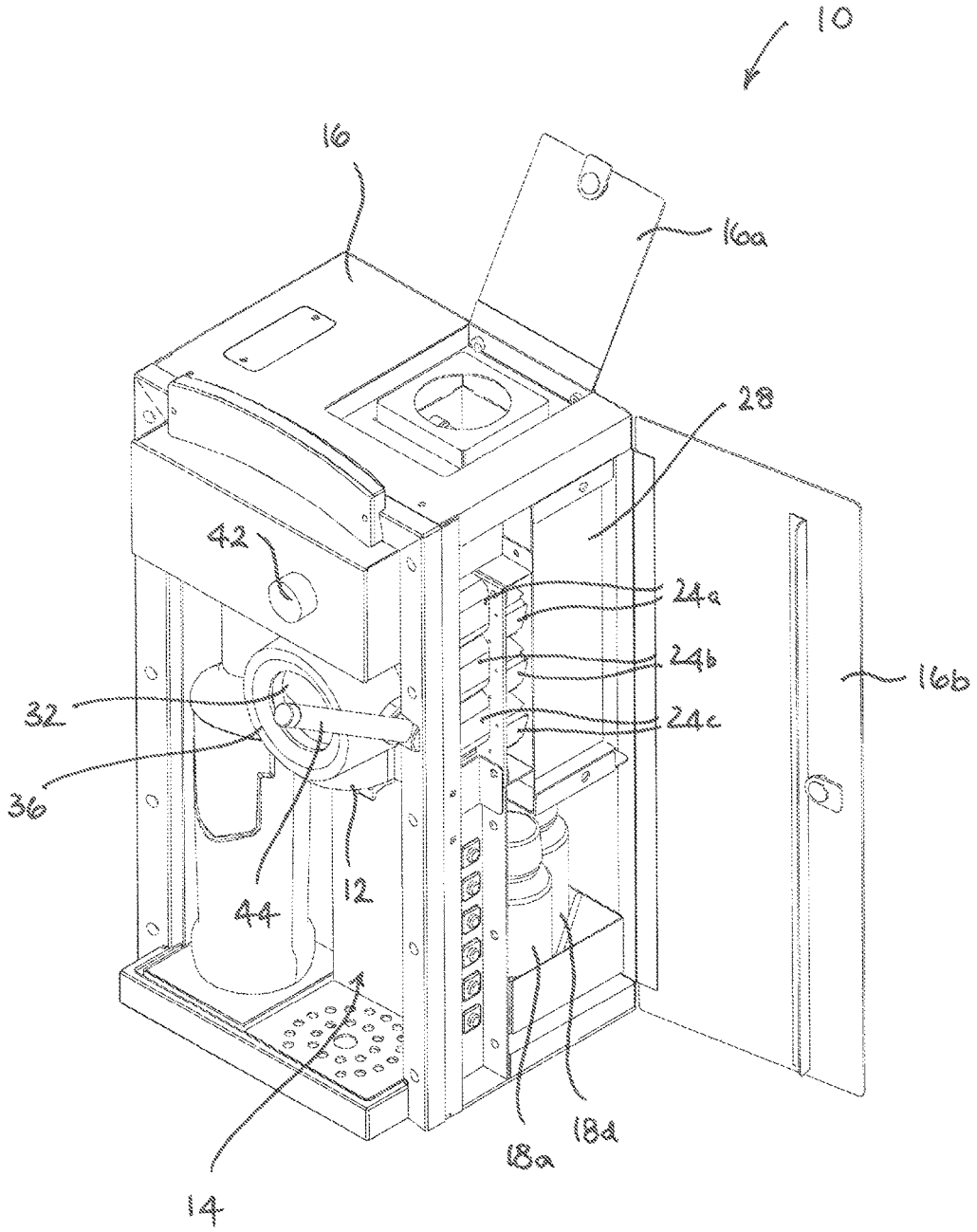
FIG. 2 is a diagrammatic perspective view of the apparatus of FIG. 1 with the access panels open and the liquid flavouring containers positioned inside the cabinet.
Figure 3:
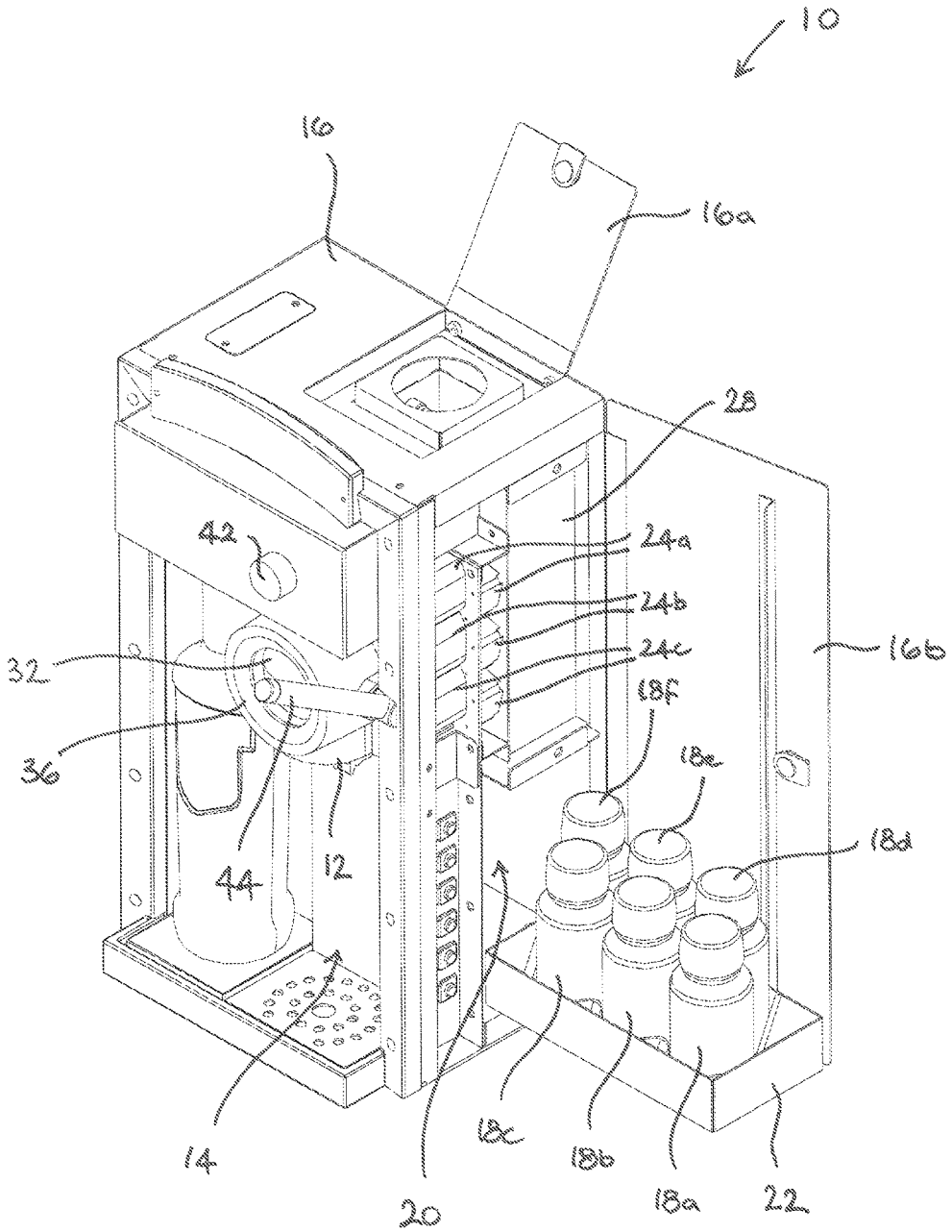
FIG. 3 is a diagrammatic perspective view of the apparatus similar to FIG. 2 in which the liquid flavouring containers are positioned outside the cabinet.
Figure 4:
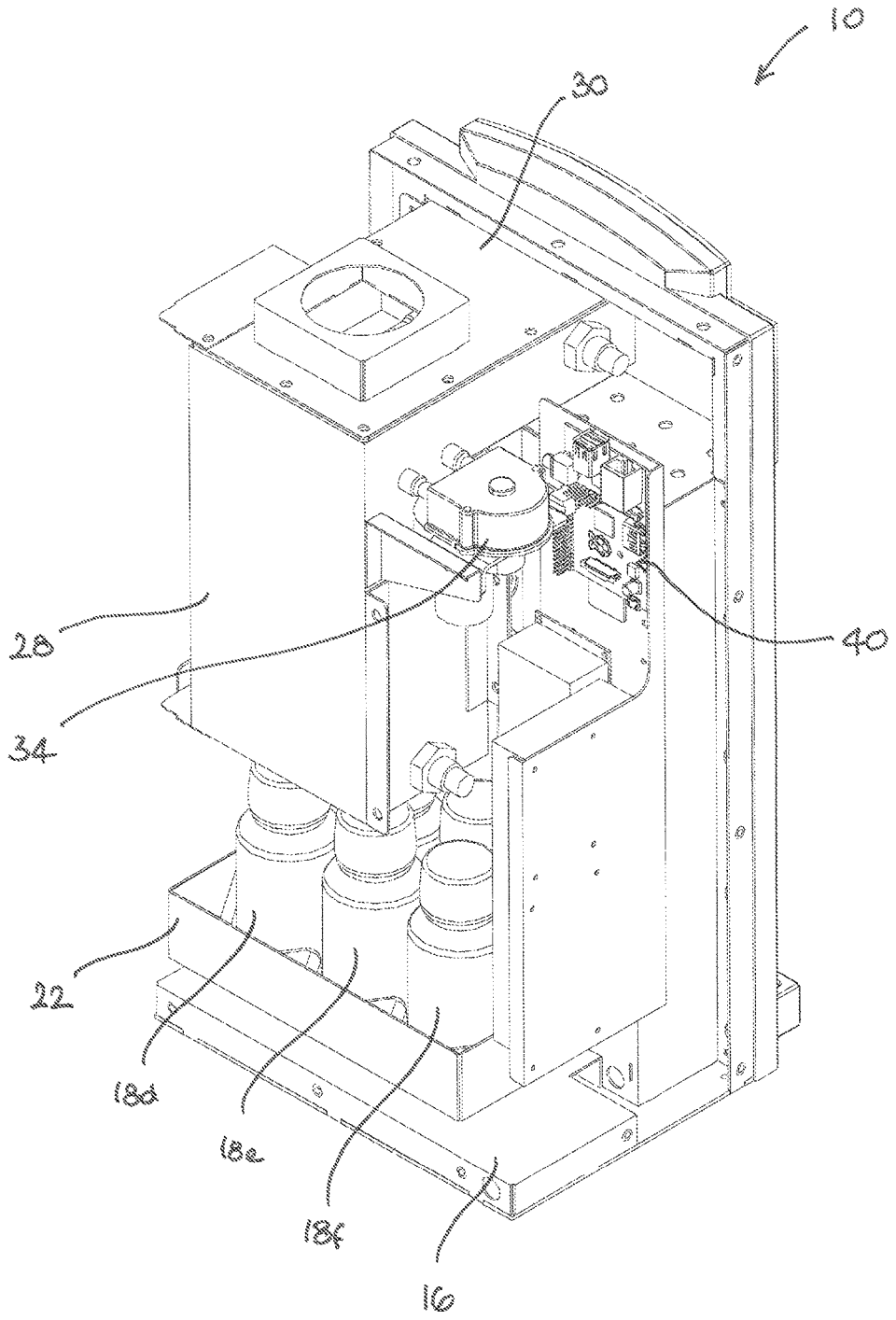
FIG. 4 is a diagrammatic perspective view of the rear of the apparatus of FIGS. 1 to 3 with part of the cabinet removed.
Figure 5:
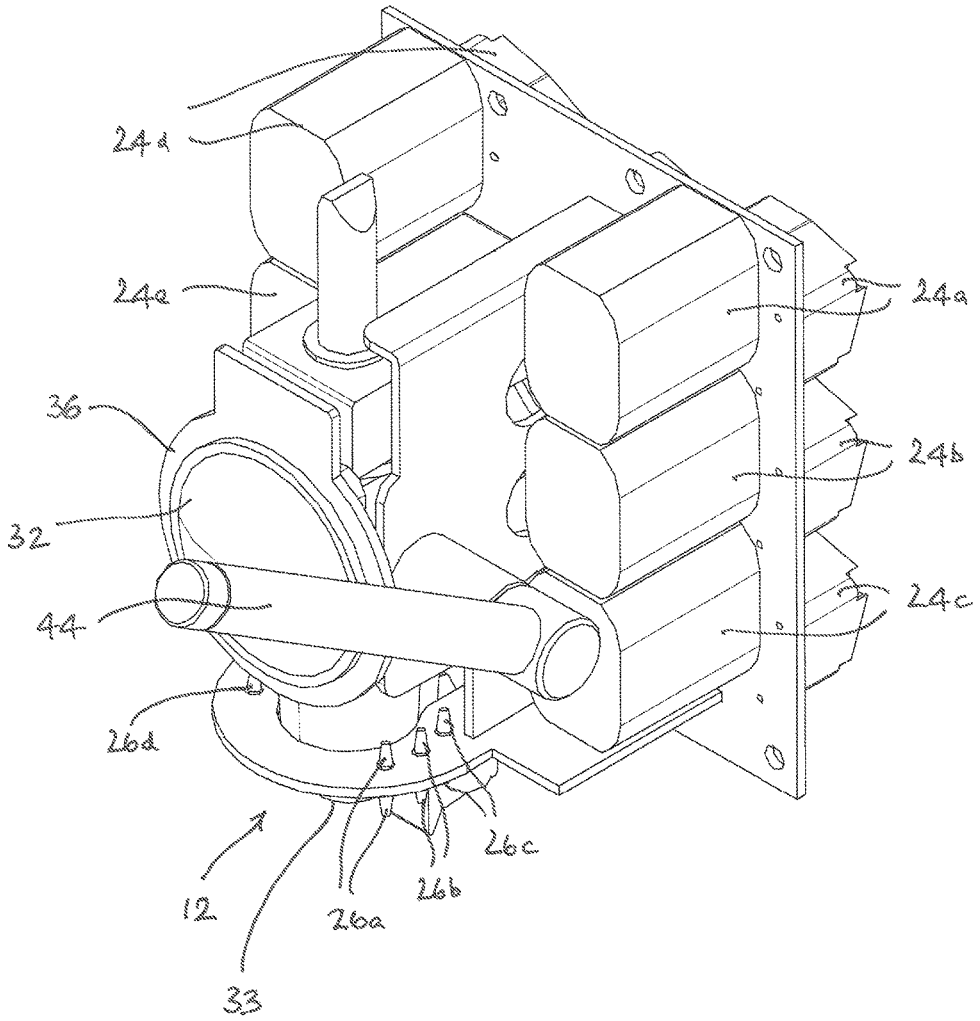
FIG. 5 is a detailed view of part of the apparatus of FIGS. 1 to 4 showing the arrangement of pumps and the dispensing outlet.

It will be apparent that in the embodiment of the apparatus 10 illustrated in FIGS. 1 to 3, a bottle is mounted in the front of the cabinet 16 to the left of the dispensing location 14. The alcoholic spirit contained in the bottle corresponds to the spirit stored in the main container 28 that is available to be dispensed by the apparatus 10 and is intended to inform potential consumers which alcoholic spirit is available.

Referring now to FIGS. 6 to 14, there is shown a second embodiment of an apparatus 50 for dispensing a flavoured beverage such as a flavoured alcoholic spirit. The beverage dispensing apparatus 50 shares some features in common with the beverage dispensing apparatus 10 shown in FIGS. 1 to 5, and corresponding features are, therefore, identified using corresponding reference numerals.

The beverage dispensing apparatus 50 is housed in a cabinet 16 having an access door 52 which provides access to an interior compartment 54 containing a plurality of cartridges 56*a-f* located in corresponding cartridge bays 57*a-f*. Each cartridge 56*a-f* is removable from its respective cartridge bay 57*a-f* in the compartment 54, as is apparent from FIGS. 8, 10*a* and 10*b* which show the cartridge 56*a* removed from its cartridge bay 57*a*.

Figure 9:
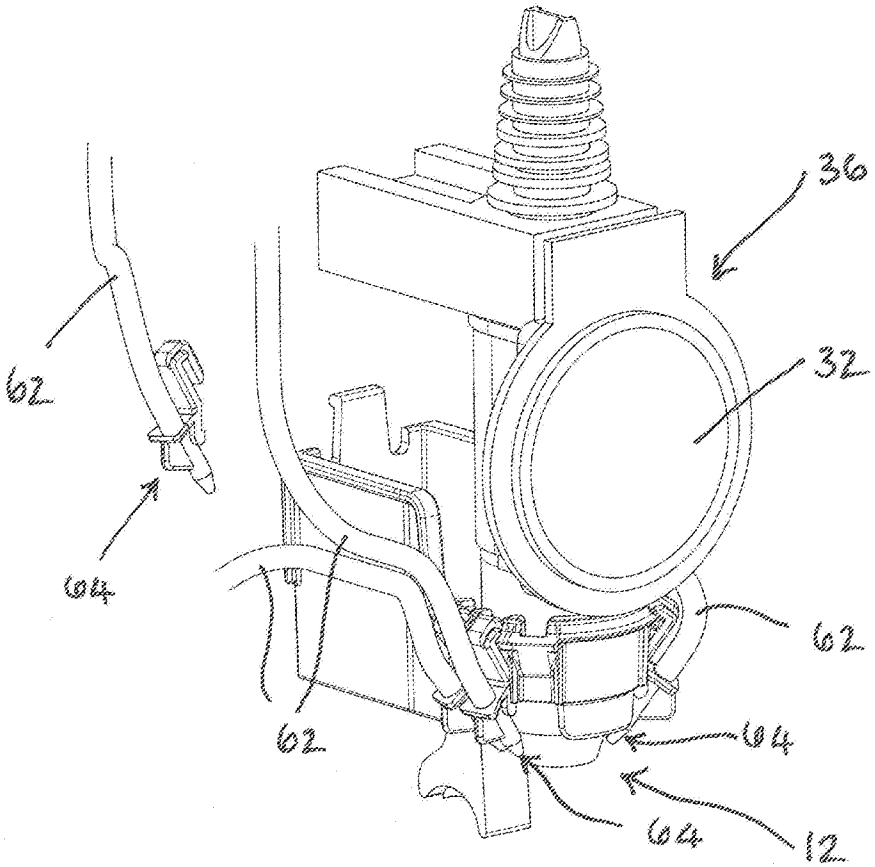
FIG. 9 is a detailed view of the dispensing outlet shown in FIGS. 6 to 8.

A liquid flavouring container 58, in the illustrated embodiment a bottle, is removably mounted inside each cartridge 56*a-f* by a container support 60 which engages the neck of the liquid flavouring container 58 to support it. Each liquid flavouring container 58 is connected by a dedicated hose 62 to a dedicated dispensing nozzle 64 from which the liquid beverage flavouring can be dispensed directly into a drinking container (not shown) locatable at the dispensing location 14 beneath the dispensing outlet 12. As best seen in FIG. 9, the dispensing nozzles 64 are individually removably mounted, for example using suitable mounting clips, at the dispensing outlet 12 and the hoses 62 are mounted in suitable guide channels 65. Thus, it will be understood that each cartridge 56*a-f* (including the container support 60 and liquid flavouring container 58), along with the associated hose 62 and dispensing nozzle 64, are removable and replaceable as a complete unit. This is particularly advantageous because the liquid beverage flavourings are highly concentrated and contaminate all components with which they come into direct contact.

The container support 60 is a moulded plastics component and has an integrated peristaltic pump 66 having a pump rotor 67, located in a stator 69, which acts on the hose 62 and can be rotated to pump the liquid beverage flavouring (as selected by the user) from the liquid flavouring container 58 to the respective dispensing nozzle 64. The apparatus 50 includes a plurality of drive motors 68*a-f* (see FIG. 12) and the control unit 40 operates the appropriate drive motor(s) 68*a-f* to dispense one or more of the liquid beverage flavourings selected by the user from the respective one or more of the dedicated dispensing nozzles 64. Each drive motor 68*a-f* includes a drive shaft (not shown) which projects into the compartment 54 at the rear and which engages an aperture 70 in the pump rotor 67. When a cartridge 56*a-f* is inserted into the appropriate cartridge bay 57*a-f* in the compartment 54, the projecting drive shaft engages the aperture 70 in the pump rotor 67.

Figure 10A:
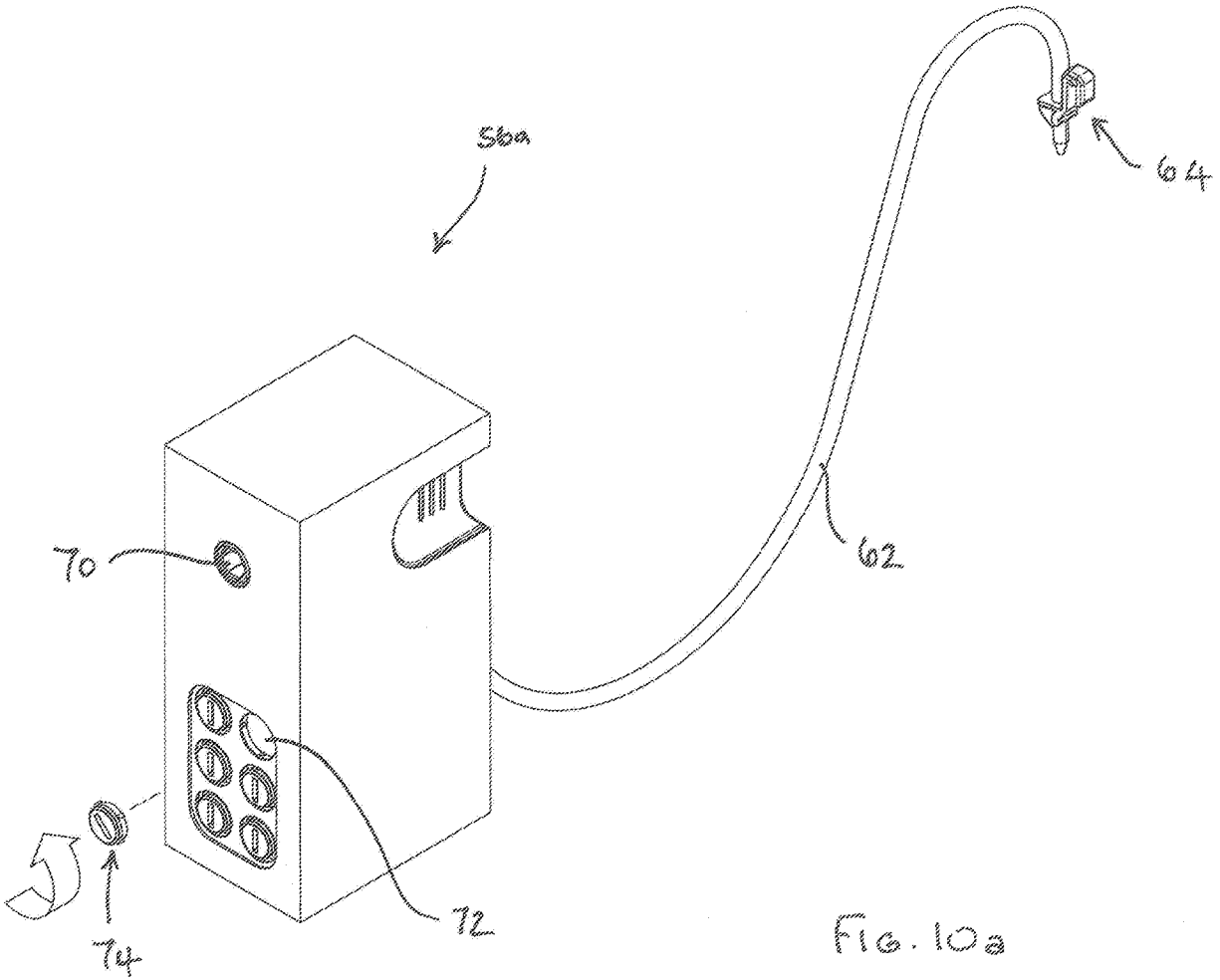
FIG. 10*a* is a detailed view from the rear of the cartridge shown in FIG. 8.
Figure 10B:
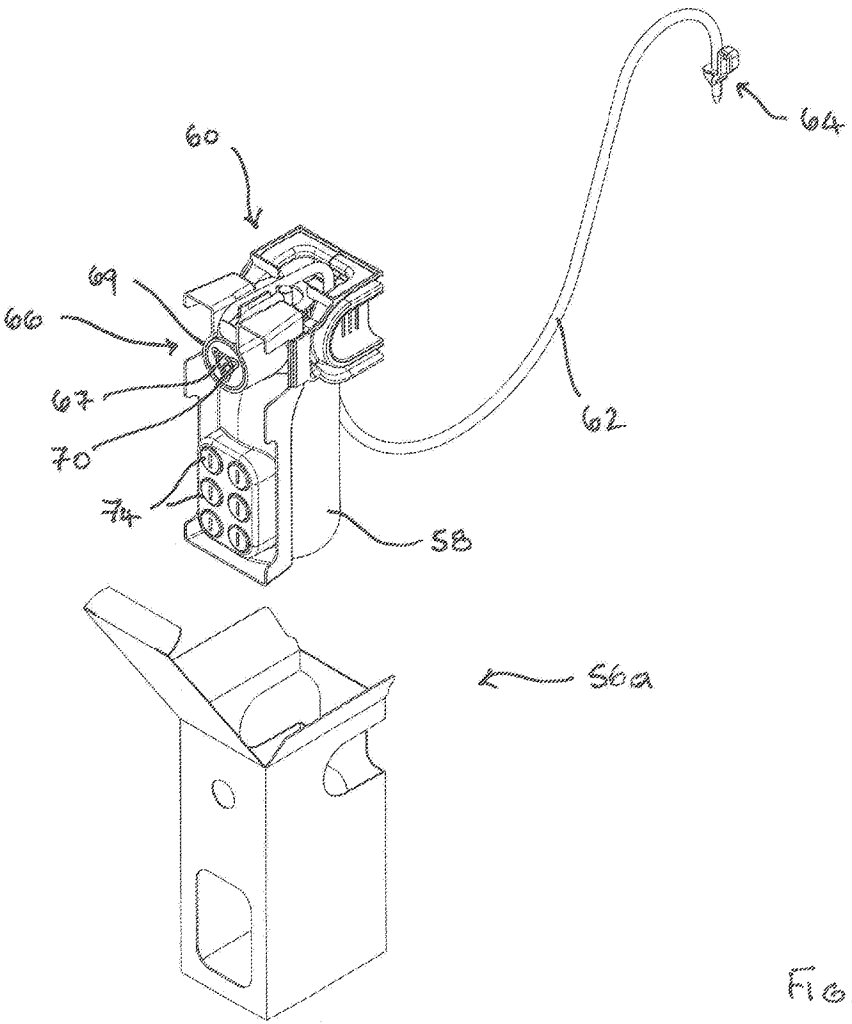
FIG. 10*b* is a view similar to FIG. 10*a* showing the liquid flavouring container and associated container support removed from the cartridge.

As will be noted from FIG. 10*a*, the container support 60 includes a plurality of locating recesses 72 covered by caps 74. The locating recesses 72 cooperate with locating projections 76 (see FIG. 8) at the rear of the cartridge bays 57*a-f* and provide a convenient way (as a 'poka-yoke' feature) to ensure that the cartridges 56*a-f* containing the liquid beverage flavourings are located in the correct cartridge bays 57*a-f* in the compartment 54. As will be appreciated, each cartridge 56*a-f* must be located in the correct cartridge bay 57*a-f* to ensure that the appropriate one or more of the liquid beverage flavourings are dispensed in accordance with the user selection.

In order to enable a user to select which of the liquid beverage flavourings they wish to be dispensed, the beverage dispensing apparatus 50 includes a selector in the form of touch sensitive switches 47 which enable the selection of one of the desired liquid beverage flavourings or a combination of the liquid beverage flavourings (to enable a 'flavour cocktail' to be produced). A display screen 46 is typically also provided to indicate the liquid beverage flavourings that are available for selection using the adjacent touch sensitive switches 47. The display screen 46 can also be arranged to display promotional videos or images.

Figure 12:
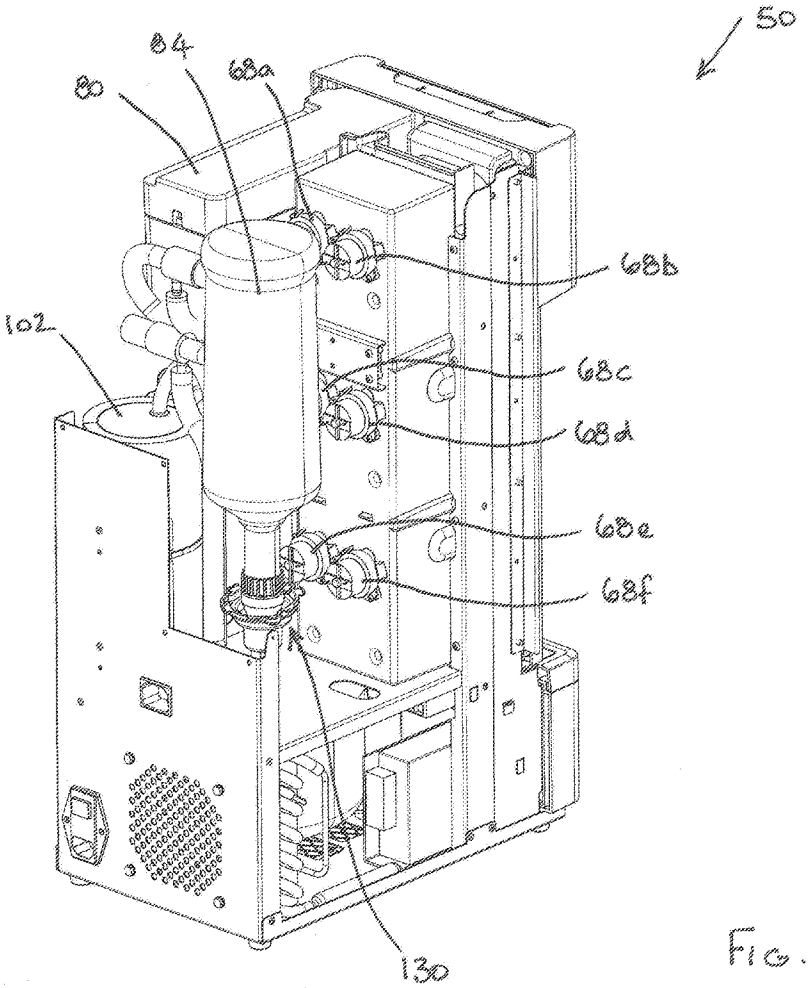
FIG. 12 is a view similar to FIG. 11 with part of the cabinet removed to show the bottle mounting assembly and the motors for driving the peristaltic pumps.
Figure 13:
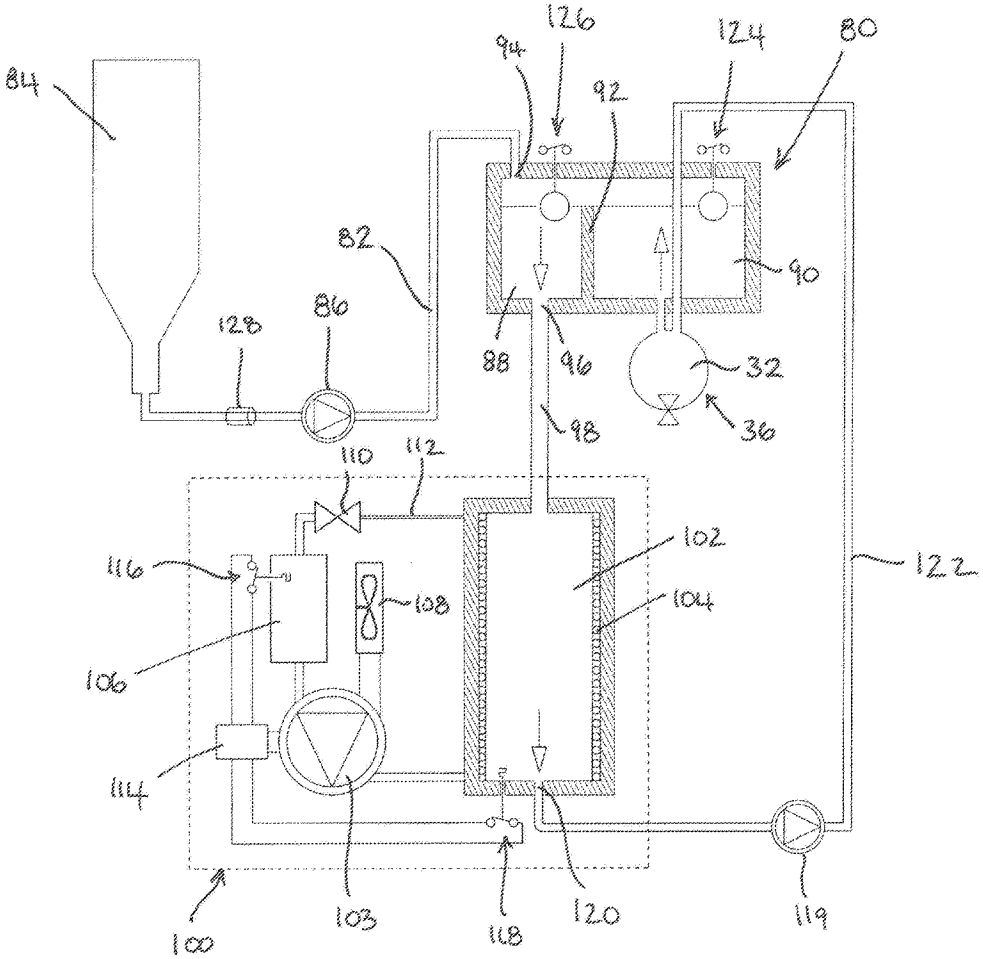
FIG. 13 is a schematic view of the chiller circuit for cooling the alcoholic beverage.

Referring now to FIGS. 12 and 13, the apparatus 50 includes a storage tank 80 for the alcoholic beverage. A delivery tube 82 connects an inverted bottle 84 containing a supply of the alcoholic beverage to the storage tank 80 and a pump 86, typically a diaphragm pump, is provided to pump the alcoholic beverage to the storage tank 80 via the delivery tube 82.

The storage tank 80 has a first storage compartment 88 and a second storage compartment 90 which are separated by a dam wall 92. Alcoholic beverage is stored in the first storage compartment 88 typically at a first temperature and in the second storage compartment 90 typically at a second temperature. The second temperature, which is typically lower than the first temperature, is the desired dispensing temperature for the alcoholic beverage. The dam wall 92 allows alcoholic beverage to flow between the first and second storage compartments 88, 90 over the top of the dam wall 92 when the level of the alcoholic beverage inside the storage tank 80 exceeds the height of the dam wall 92.

The first storage compartment 88 has an inlet 94 which is connected to the delivery tube 82 and alcoholic beverage is, thus, delivered from the inverted bottle 84 to the first storage compartment 88 by the diaphragm pump 86. The first storage compartment 88 also has an outlet 96 which is connected by a hose 98 to an inlet into an insulated chiller tank 102 which forms part of a refrigeration unit 100. The refrigeration unit 100 includes an evaporator coil 104 positioned around the chiller tank 102 to cool the alcoholic beverage in the chiller tank 102 to the aforementioned second temperature (i.e. the desired dispensing temperature). The refrigeration unit 100 includes a temperature selector 101 (FIG. 7) which allows a user to select the second temperature.

The refrigeration unit includes a compressor 103, a condenser 106, a fan 108 and a drier 110. The compressor 103 compresses a low pressure gas to a higher pressure and pumps the high pressure gas to the condenser 106. The condenser 106 then converts the high pressure gas to a high pressure liquid by extracting the heat from the gas. Heat is transferred to air passing over the condenser 106 and the fan 108 directs air over the condenser 106 to assist with the heat extraction. The drier 110 removes any residual moisture. Finally, a capillary tube 112 is provided to control the flow of high pressure liquid entering into the evaporator coil 104. A control unit 114 connected to thermostatic switches 116, 118 is provided to control the operation of the refrigeration unit 100.

The chiller tank 102 is located beneath the first storage compartment 88 and alcoholic beverage is supplied from the first storage compartment 88 to the chiller tank 102 by gravity feed. The chiller tank 102 has an outlet 120 which is connected via a hose 122 directly to the dispensing chamber 32 of the optic device 36 provided at the dispensing outlet 12. As will be noted from FIG. 13, the dispensing chamber 32 is in fluid communication with the second storage compartment 90 and, more particularly, is located immediately beneath the second storage compartment 90.

When the apparatus 50 is used for the first time, alcoholic beverage is delivered by the pump 86 via the delivery tube 82 to the first storage compartment 88. The alcoholic beverage then flows under the action of gravity from the first storage compartment 88 into the chiller tank 102 where it is cooled to a desired temperature. The cooled alcoholic beverage is then delivered by a pump 119, typically a diaphragm pump, from the chiller tank 102 to the dispensing chamber 32. When the dispensing chamber 32 is full, continued delivery of the cooled alcoholic beverage to the dispensing chamber 32 causes the second storage compartment 90 to be filled with the cooled alcoholic beverage. A liquid level sensor 124 is provided to detect the level of alcoholic beverage in the second storage compartment 90. When the volume of alcoholic beverage in the second storage compartment 90 reaches a desired predetermined maximum level which is set to be lower than the top of the dam wall 92, the liquid level sensor 124 is deactivated and this causes the control unit 40 to terminate the operation of the pump 119 so that no further alcoholic beverage is delivered to the second storage compartment 90.

A liquid level sensor 126 is similarly provided to detect the level of alcoholic beverage in the first storage compartment 88. When the volume of alcoholic beverage in the first storage compartment 88 reaches a predetermined maximum level below the top of the dam wall 92 and typically below the predetermined maximum level in the second storage compartment 90, the liquid level sensor 126 is deactivated and this causes the control unit 40 to terminate the operation of the pump 86 so that no further alcoholic beverage is delivered from the inverted bottle 84 to the first storage compartment 88.

As already explained in connection with the beverage dispensing apparatus 10, when the handle member 44 is rotated by a user (in the downward direction), it acts mechanically on the optic device 36 so that the measured volume of alcoholic beverage is dispensed from the dispensing chamber 32 into the drinking container positioned at the dispensing location 14 beneath the dispensing outlet 12. Once the handle member 44 has returned to its starting position, alcoholic beverage flows under gravity from the second storage compartment 90 into the dispensing chamber 32 to refill it. The level of alcoholic beverage in the second storage compartment 90 decreases as alcoholic beverage flows from the second storage compartment 90 into the dispensing chamber 32 and the reduction in the liquid level activates the liquid level sensor 124. This sends a signal to the control unit 40 which in turn activates the pump 119 to deliver alcoholic beverage at the second temperature from the chiller tank 102 directly into the dispensing chamber 32. Since the dispensing chamber 32 already contains a sufficient volume of alcoholic beverage for a further dispense (as already supplied by the gravity feed from the second storage compartment 90), the second storage compartment 90 is back filled and the level of alcoholic beverage in the second storage compartment 90 increases until the liquid level sensor 126 is deactivated (indicating that the second storage compartment 90 has been filled to the predetermined maximum level), thereby causing the control unit 40 to deactivate the pump 119 so that no further alcoholic beverage is delivered from the chiller tank 102 to the second storage compartment 90.

The delivery of cooled alcoholic beverage from the chiller tank 102 to the dispensing chamber 32, and hence to the second storage compartment 90, causes a reduction in the level of alcoholic beverage in the chiller tank 102. Alcoholic beverage (typically at the first temperature) immediately flows under gravity from the first storage compartment 88 into the chiller tank 102 to refill it. The level of alcoholic beverage in the first storage compartment 88 decreases as alcoholic beverage flows from the first storage compartment 88 into the chiller tank 102 and the reduction in the liquid level activates the liquid level sensor 126. This sends a signal to the control unit 40 which in turn activates the pump 86 to deliver alcoholic beverage from the inverted bottle 84 to the first storage compartment 88 via the delivery tube 82.

The provision of first and second storage compartments 88, 90 which are separated by an insulated dam wall 92 and the provision of a chiller tank 102 and associated refrigeration unit 100 ensures that the alcoholic beverage is always supplied directly to the dispensing outlet 32 in the optic device 36 at the second temperature, i.e. the optimum dispensing temperature.

If the apparatus 50 is not used for a period of time, the control unit 40 is arranged to override the liquid level sensor 124 to operate the pump 119 as a recirculating pump. This ensures that the alcoholic beverage in the dispensing chamber 32 and the second storage compartment 90 is maintained substantially at the second temperature, i.e. the optimum dispensing temperature. In more detail, if the control unit 40 detects that the handle member 44 has been inoperative for a predetermined period of time, for example 10 minutes, thereby indicating that alcoholic beverage has not been dispensed from the dispensing chamber 32, the control unit 40 activates the pump 119 for a predetermined recirculation period (e.g. 30 seconds) to deliver alcoholic beverage at the second temperature from the chiller tank 102 to the dispensing chamber 32 via the hose 122. This causes an increase in the volume of alcoholic beverage in the second storage compartment 90 and thereby causes the alcoholic beverage in the second storage compartment 90 to flow over the top of the dam wall 92 into the first storage compartment 88. Simultaneously, alcoholic beverage from the first storage compartment 88 flows under gravity into the chiller tank 102 to replace the cooled alcoholic beverage that has been delivered by the pump 119 to the dispensing chamber 32 and, hence, the second storage compartment 90.

The apparatus 50 includes a liquid sensor 128 which continuously detects the presence of alcoholic beverage in the inverted bottle 84. When the inverted bottle 84 is empty and the liquid sensor 128 no longer detects the presence of liquid in the bottle 84, the control unit 40 will not operate the pump 86 when further dispensing operations are carried out by a user to dispense alcoholic beverage from the dispensing chamber 32 and will alert the user that the bottle 84 needs to be replaced. If the bottle 84 is not replaced, it will be appreciated that further dispensing operations can be carried out until such time as the alcoholic beverage in the first and second storage compartments 88, 90 and the chiller tank 102 has been depleted. In practice, it is expected that the bottle 84 will be replaced by the user at the appropriate time so that the operation of the apparatus 50 can continue uninterrupted, in the manner described above.

Figure 11:
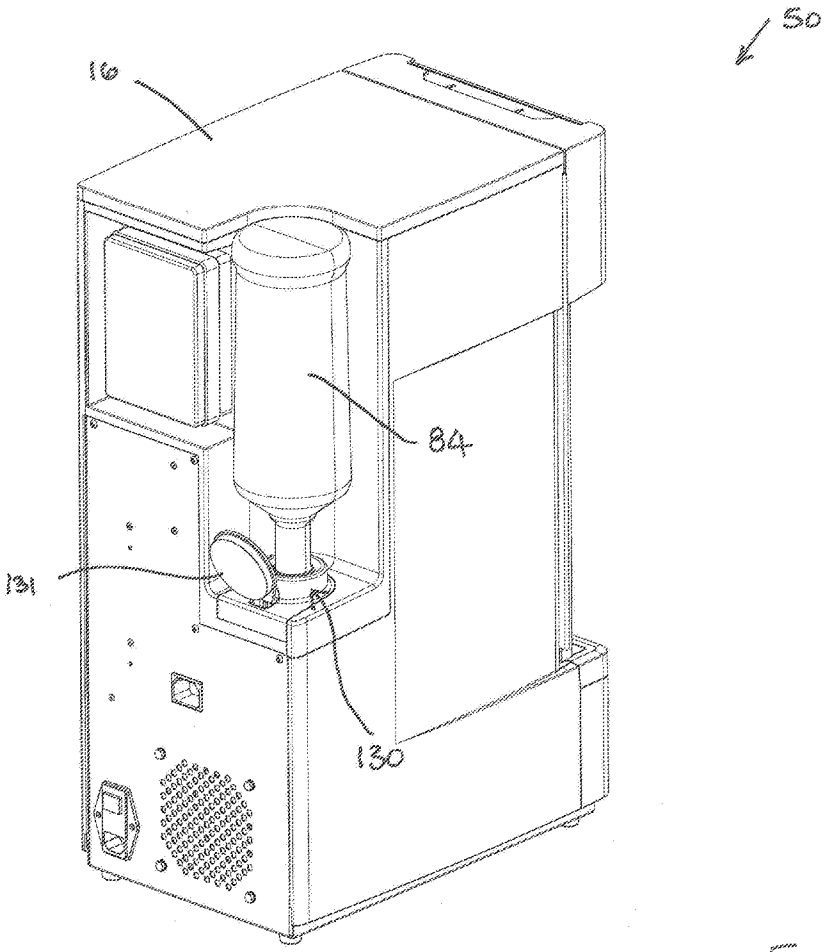
FIG. 11 is a diagrammatic perspective view from the rear of the apparatus shown in FIGS. 6 to 8.
Figure 14A:
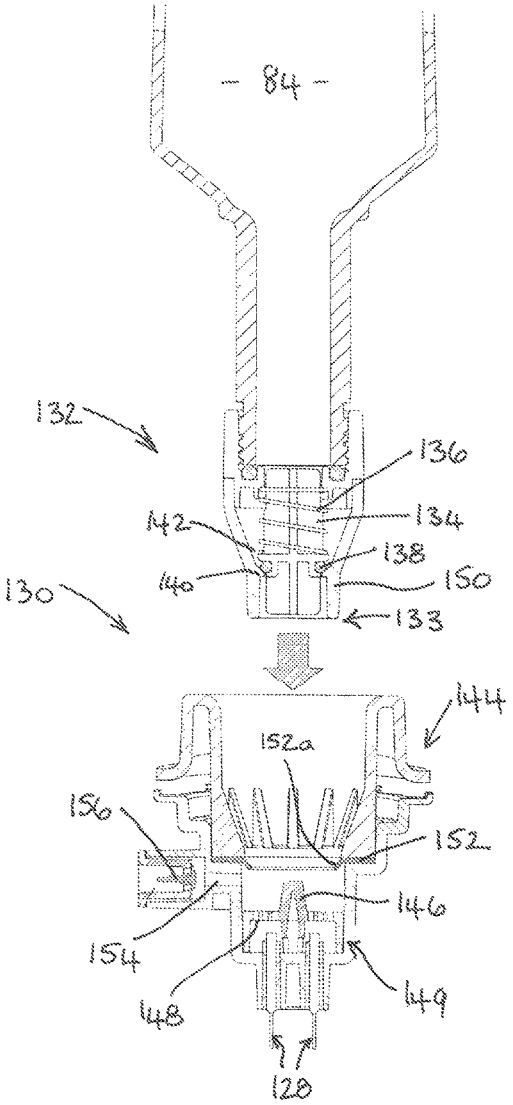
FIGS. 14*a* and 14*b* are cross-sectional views of the bottle mounting assembly shown in FIG. 12.

Referring now to FIGS. 11, 12, 14*a* and 14*b*, it will be seen that the apparatus 50 includes a bottle mounting assembly 130 for mounting the bottle 84 containing the supply of alcoholic beverage in an inverted position on the apparatus 50. A movable cover member 131, shown in the open position in FIG. 11, is provided to cover the bottle mounting assembly 130 if the bottle 84 is removed for an extended period of time or during transport of the apparatus 50. As best seen in FIG. 14*a*, a stopper valve 132 is screwed onto the threaded neck of the bottle 84 by a user after the bottle cap has been removed by unscrewing it. The stopper valve 132 has a plunger 134 which is biased into a closed positioned as shown in FIG. 14*a* by a spring 136. The spring-biased plunger 134 includes a sealing element 138 which contacts a circumferential ridge 140 to close a discharge orifice 142, thus ensuring that alcoholic beverage cannot flow from the bottle 84 through the discharge orifice 142 when the bottle 84 is inverted.

Figure 14B:
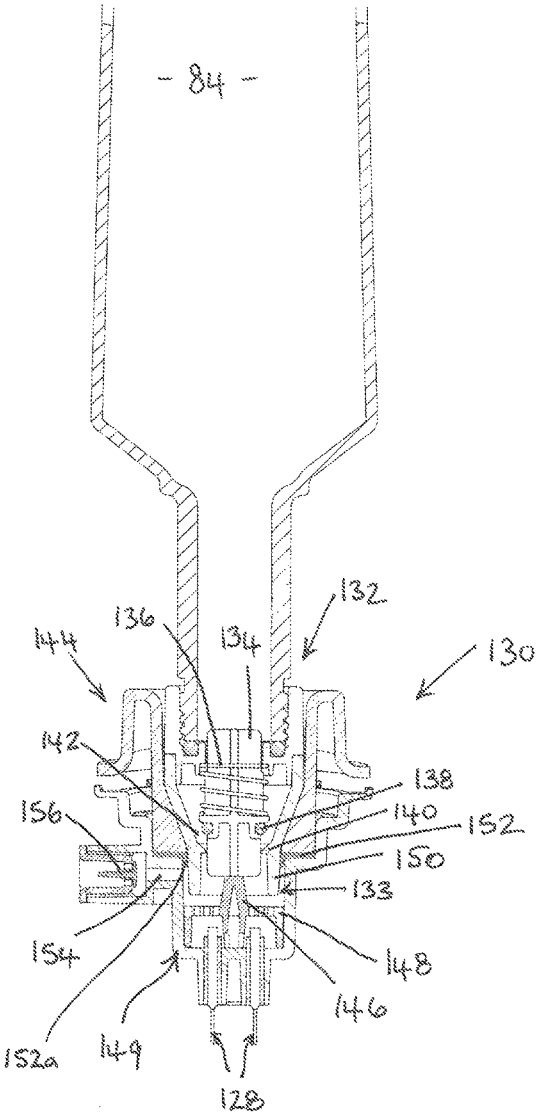

The bottle mounting assembly 130 comprises a collar 144 which is configured to receive and seat the stopper valve 132, as shown in FIG. 14*b*, and which includes the liquid sensor 128 described above. The collar 144 includes an upwardly extending actuating spigot 146 which forms part of a strainer 148 having apertures therein. As will be appreciated from a comparison of FIGS. 14*a* and 14*b*, the actuating spigot 146 depresses the plunger 134 against the bias of the spring 136 when the stopper valve 132 is correctly seated in the collar 144. This opens the discharge orifice 142 and allows alcoholic beverage to flow under gravity from the inverted bottle 84 into a sump part 149 formed in the lower part of the collar 144. When the level of the alcoholic beverage in the sump part 149 reaches the lower periphery 133 of the neck 150 of the stopper valve 132, the alcoholic beverage creates a seal and prevents further alcoholic beverage from flowing out of the inverted bottle 84 through the discharge orifice 142.

The bottle mounting assembly 130 includes a circumferentially extending seal 152 with a downwardly depending lip 152*a* on its inner circumference which engages the neck 150 of the stopper valve 132 when the stopper valve 132 is seated in the collar 144. The bottle mounting assembly 130 also includes a vent hole 154 and a one-way umbrella valve 156 fitted to the vent hole 154. The one-way umbrella valve 156 allows air to flow into the inverted bottle 84 through the vent hole 154 when the pump 86 is operated to deliver alcoholic beverage from the inverted bottle 84, in particular from the sump part 149, to the first storage compartment 88. The vent hole 154 is provided in the collar 144 at a vertical position below the seal 152 and above the lower periphery 133 of the neck 150 of the stopper valve 132 when the stopper valve 132 is correctly seated in the collar 144 such that the spring-biased plunger 134 is depressed by the actuating spigot 146 to open the discharge orifice 142.

In order to facilitate operation of the apparatus 50 and ensure that it is ready for use as quickly as possible, it is likely that the bottle 84 containing the alcoholic beverage will be pre-chilled, for example to a temperature of −20° C. in the case of an alcoholic spirit such as vodka. If the inverted bottle 84 mounted on the bottle mounting assembly 130 contains an air pocket (which is likely), the air will expand as it is warms up to ambient temperature and this expansion will displace at least some of the alcoholic beverage out of the inverted bottle 84. In this situation, the seal 152 prevents the escape of the displaced alcoholic beverage from the interface between the neck 150 of the stopper valve 132 and the collar 144 whilst the one-way umbrella valve 156 prevents the escape of the alcoholic beverage through the vent hole 154. The alcoholic beverage is displaced by the expanded air from the inverted bottle 84 along the delivery tube 82 (through the diaphragm pump 86) and into the first storage compartment 88, which has a sufficient volume that it can store the alcoholic beverage displaced from the inverted bottle 84.

In order to prepare the apparatus 50 so that it is ready for use, a plurality of cartridges 56*a-f* are loaded into the appropriate cartridge bays 57*a-f* in the compartment 54. The hoses 62 are located in the appropriate guide channels 65 and the dispensing nozzles 64 are mounted at the dispensing outlet 12. Because the cartridges 56*a-f* already contain the container supports 60 with integrated peristaltic pumps 66 and liquid flavouring containers 58, loading the cartridges 56*a-f* is a simple procedure for the user, in particular because the user does not have to make any connections or assemble the components of the peristaltic pump 66.

Typically, the peristaltic pumps 66 are primed to remove air from the hoses 62 and to ensure that the liquid beverage flavourings are ready to be dispensed from the dispensing nozzles 64 at the dispensing outlet 12. The user primes the peristaltic pumps by depressing the appropriate keys on a keypad 158 (FIG. 8) located in the compartment 54.

The cover member 131 is moved by the user to the open position shown in FIG. 11 so that a bottle 84 containing a supply of the desired alcoholic beverage and fitted with the stopper valve 132, can be mounted on the apparatus 50 by seating the stopper valve 132 in the collar 144. The control unit 40 operates the pumps 86, 119 and the refrigeration unit 100 in the manner described above to fill the storage tank 80 and the dispensing chamber 32 with the alcoholic beverage. Once the control unit determines that the dispensing chamber 32 and second storage compartment 90 contain alcoholic beverage at the second temperature, an appropriate signal is provided to the user (for example by way of suitable illumination in the region of the optic device 36) to indicate that the apparatus 50 is ready for use.

For the avoidance of doubt, the aforementioned steps do not have to be carried out in this exact sequence and any suitable sequence can be adopted. For example, the inverted bottle 84 can be mounted on the apparatus 50 before the cartridges 56*a-f* are loaded into the cartridges bays 57*a-f* in the compartment 54.

The apparatus 50 is typically located on a counter top, such as a bar counter, along with other alcoholic beverages at a location where the flavoured alcoholic beverage will be consumed. Depending on the particular flavour of alcoholic beverage required by the consumer, the user (typically a bar tender) will press one or more of the appropriate touch sensitive keys 47 to select the desired liquid beverage flavouring or flavourings and that selection will be communicated to the control unit 40.

As explained above in connection with the beverage dispensing apparatus 10, in order to initiate the dispensing operation, the user operates the rotatable handle member 44 thus dispensing the predetermined volume of the alcoholic beverage from the dispensing chamber 32. The rotation of the handle member 44 by the user also operates a switch which causes the control unit 40 to operate the appropriate one or more of the drive motors 68*a-f*, and hence the corresponding peristaltic pump(s) 66, to supply the one or more liquid beverage flavourings selected by the user via the touch sensitive keys 47 from the one or more liquid flavouring containers 58 to the corresponding dispensing nozzle or nozzles 64. As mentioned above, the control unit 40 is calibrated to operate the appropriate drive motor(s) 68*a-f*, and hence the appropriate peristaltic pump(s) 66, for a predetermined period of time so that a predetermined volume of the or each of the selected liquid beverage flavouring(s) is dispensed from the corresponding dispensing nozzle 64 at the dispensing outlet 12.

After the dispensing operation has been completed, the control unit 40 operates the pumps 119, 86 in the manner described above to deliver further alcoholic beverage at the second temperature from the chiller tank 102 to the dispensing chamber 32 (and hence to the second storage compartment 90) and from the inverted bottle 84 to the first storage compartment 88, thus ensuring that the apparatus 50 is immediately ready to perform further dispensing operations.

Figure 6:
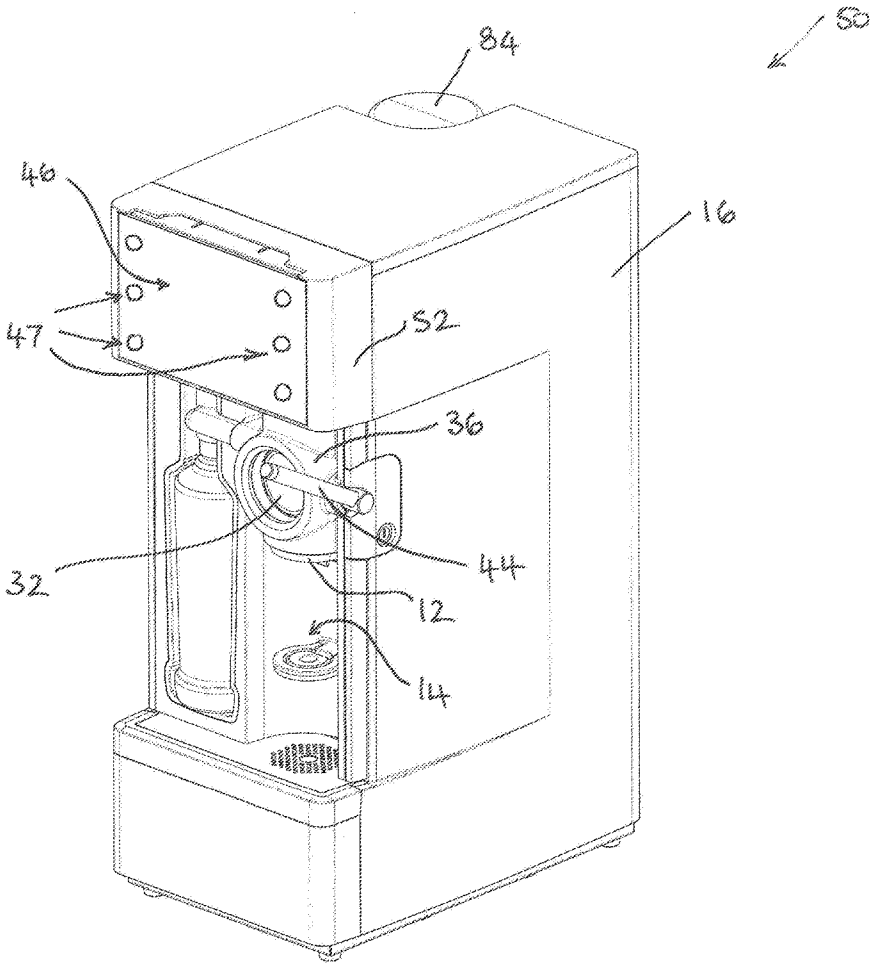
FIG. 6 is a diagrammatic perspective view from the front of an apparatus for dispensing a flavoured alcoholic beverage according to a second embodiment of the present disclosure.
Figure 7:
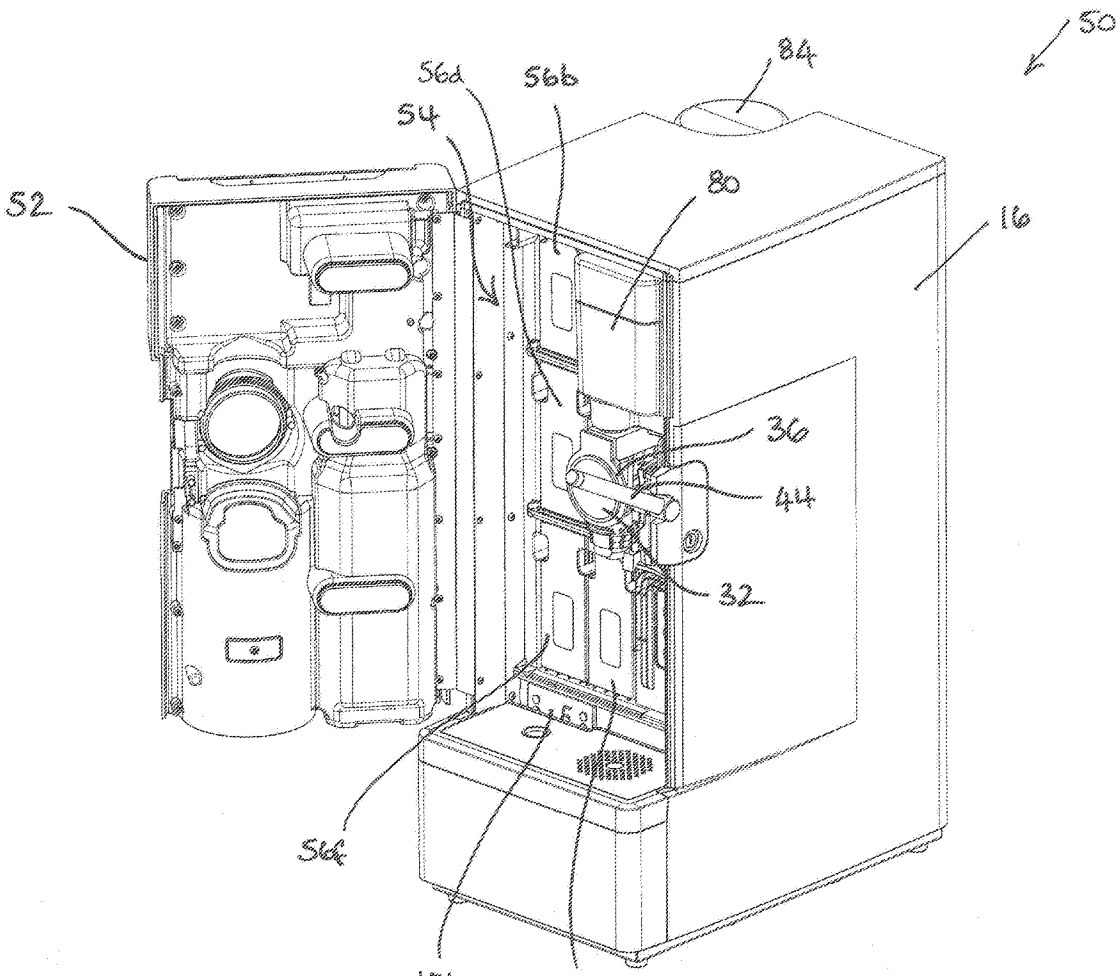
FIG. 7 is a view similar to FIG. 6 with the access door in an open position.
Figure 8:
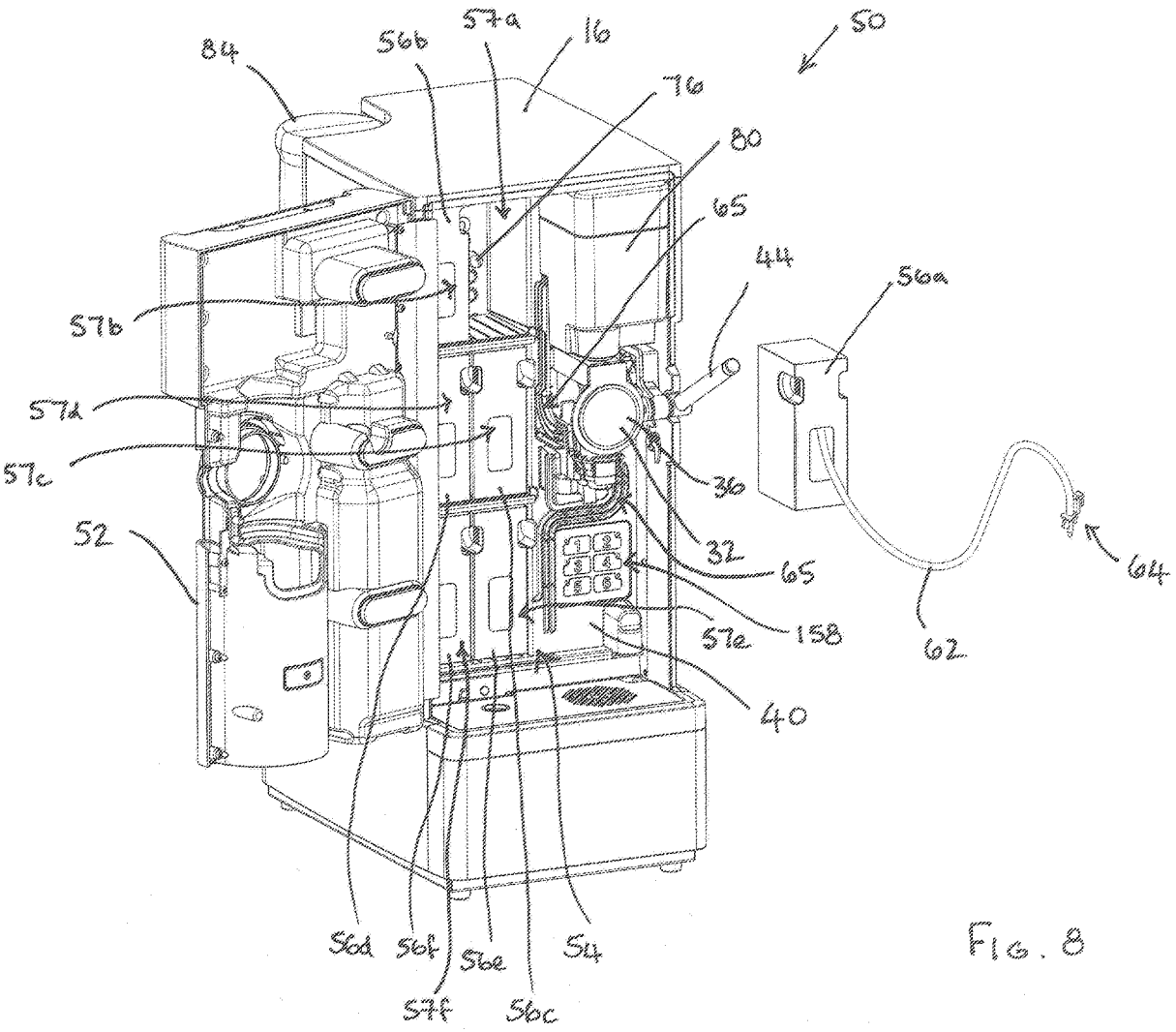
FIG. 8 is a view similar to FIG. 7 showing a cartridge containing a liquid flavouring container removed from the cabinet.

It will be noted, as best seen in FIG. 6, that a bottle is mounted in a recess in the front of the access door 52, to the left of the dispensing location 14. The alcoholic beverage contained in this bottle corresponds to the alcoholic beverage stored in the inverted bottle 84, but it should be understood that the alcoholic beverage is not actually dispensed from this bottle and that it is provided purely for the purpose of informing potential consumers about the alcoholic beverage that is available for dispensing by the apparatus 50.

The beverage dispensing apparatus 50 is typically configured so that the control unit 40 will prevent further dispenses of a liquid beverage flavouring after a predetermined number of dispensing operations, and the control unit 40 thus maintains a dispense count sequence for each of the liquid beverage flavourings. This way it is not necessary to provide liquid sensors to continuously monitor the quantity of liquid beverage flavouring inside each liquid flavouring container 58. Typically, the control unit 40 is configured to alert a user after a first predetermined number of dispensing operations (e.g. 700 dispenses in the case of a 150 ml liquid flavouring container based on a dispense volume of 0.17-0.20 ml per dispense) that the cartridge 56*a-f* containing the appropriate liquid beverage flavouring will soon need replacement. After a second predetermined number of dispensing operations (e.g. 720 dispenses in the case of the aforesaid 150 ml liquid flavouring container and dispense volume), the control unit 40 is arranged to prevent further dispenses of the liquid beverage flavouring, for example by making the particular liquid beverage flavouring unavailable for selection using the touch sensitive keys 47.

The apparatus 50 can, if desired, be used to dispense the alcoholic beverage from the dispensing chamber 32 without the addition of one or more of the liquid beverage flavourings. This is achieved simply by operating the handle member 44 without firstly selecting any of the available liquid beverage flavourings using the touch sensitive keys 47.

The dispense count sequence maintained by the control unit 40 provides a convenient way to monitor the dispensing operation, to maintain internal stock control and to report elementary sales data. The dispense count sequence and other information relating to the dispensing operation are stored by the control unit 40 and can be accessed locally, for example by downloading to a personal computer or similar electronic device, or remotely, for example via a telemetry module.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments. Each feature disclosed in the specification, including the claims and drawings, may be replaced by alternative features serving the same, equivalent or similar purposes, unless expressly stated otherwise.

For example, although the beverage dispensing apparatus 10, 50 have been described in connection with the dispensing of an alcoholic beverage such as an alcoholic spirit, the apparatus 10, 50 are equally suitable for dispensing any type of alcoholic beverage or non-alcoholic beverage.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

Any combination of the above-described features in all possible variations thereof is encompassed by the present invention unless otherwise indicated herein or otherwise clearly contradicted by context.

The invention claimed is:

1. An apparatus for dispensing a flavoured beverage, the apparatus being housed in a cabinet and comprising:

a dispensing outlet connectable to a beverage supply and a plurality of different liquid beverage flavourings, the dispensing outlet being configured to dispense the beverage and a selected one or more of the liquid beverage flavourings into a drinking container;

an actuating member operable by a user to initiate dispensing of the beverage and a selected one or more of the liquid beverage flavourings from the dispensing outlet;

a selector configured to receive a user input selection of one or more of the plurality of liquid beverage flavourings to be dispensed;

a control unit; and a pump;

wherein, upon user operation of the actuating member, the control unit is arranged to operate the pump to supply a selected one or more of the liquid beverage flavourings to the dispensing outlet based on the user input selection received by the selector;

wherein the apparatus is configured to dispense a predetermined volume of beverage from the dispensing outlet upon user operation of the actuating member and includes a dispensing chamber configured to store the predetermined volume of beverage to be dispensed from the dispensing outlet, and wherein the apparatus includes a storage tank for the beverage, and the storage tank includes a first storage compartment for storing the beverage at a first temperature, a second storage compartment for storing the beverage at a second temperature which is lower than the first temperature, and the second storage compartment is in fluid communication with the dispensing chamber.

2. An apparatus according to claim 1, wherein the apparatus includes a plurality of pumps, each pump being arranged to supply one of the liquid beverage flavourings to the dispensing outlet.

3. An apparatus according to claim 1, wherein each of the liquid beverage flavourings is stored in a separate, individually removable and replaceable, liquid flavouring container.

4. An apparatus according to claim 3, wherein each liquid flavouring container is connected by a hose to a flavour dispensing nozzle at the dispensing outlet.

5. An apparatus according to claim 4, wherein each liquid flavouring container is removably mounted on a respective container support having an integrated pump for delivering the liquid beverage flavouring from the liquid flavouring container along the hose to the flavour dispensing nozzle.

6. An apparatus according to claim 5, wherein each container support is removably located in the cabinet, the integrated pump is a peristaltic pump, and the apparatus includes a plurality of rotary drives, each rotary drive being arranged to engage a rotor of one of the peristaltic pumps to operate the peristaltic pump.

7. An apparatus according to claim 6, wherein each rotary drive comprises an electric motor having a drive part which is engageable with the rotor of the peristaltic pump.

8. An apparatus according to claim 5, wherein each liquid flavouring container and associated container support are mounted in a cartridge removably located in the cabinet.

9. An apparatus according to claim 1, wherein the control unit is configured to operate the pump to supply a predetermined volume of the selected one or more of the liquid beverage flavourings to the dispensing outlet.

10. An apparatus according to claim 1, wherein the apparatus includes a refrigeration unit for cooling the beverage to the second temperature.

11. An apparatus according to claim 10, wherein the refrigeration unit includes a chiller tank in fluid communication with the first and second storage compartments, the apparatus being arranged to supply the beverage at the first temperature from the first storage compartment to the chiller tank and to deliver chilled beverage at the second temperature from the chiller tank to the dispensing chamber.

12. An apparatus according to claim 11, wherein the chiller tank is positioned below the storage tank so that the beverage is supplied from the first storage compartment to the chiller tank by gravity feed, and the apparatus includes a pump for delivering the chilled beverage at the second temperature from the chiller tank to the dispensing chamber.

13. An apparatus according to claim 12, wherein the pump is selectively operable to circulate beverage around a cooling loop from the second storage compartment to the first storage compartment, from the first storage compartment to the chiller tank and from the chiller tank to the dispensing chamber.

14. An apparatus according to claim 1, wherein the apparatus includes a bottle mounting assembly for removably mounting an inverted bottle containing a supply of the beverage, and a delivery pump for delivering the beverage from the inverted bottle to the first storage compartment via a delivery tube.

15. An apparatus according to claim 14, wherein the control unit is adapted to operate the delivery pump when the volume of beverage in the first storage compartment is less than a predetermined amount.

16. An apparatus according to claim 14, wherein the bottle mounting assembly comprises: a collar for receiving a stopper valve, having a spring-biased plunger closing a discharge orifice, fitted to the bottle; an actuating spigot arranged to depress the spring-biased plunger to allow the beverage to flow from the inverted bottle through the discharge orifice; and a sealing member arranged to contact a neck of the stopper valve.

17. An apparatus according to claim 16, wherein the collar includes a vent hole and associated one-way air inlet valve which are arranged to allow air to flow into the inverted bottle as beverage is delivered from the inverted bottle to the first storage compartment by the delivery pump.

18. An apparatus according to claim 17, wherein the vent hole is provided in the collar at a vertical position below the sealing member and above a lower periphery of the neck of the stopper valve when the stopper valve is located in the collar.

* * * * *